United States Patent [19]

Mabrouk et al.

[11] Patent Number: 4,879,577

[45] Date of Patent: Nov. 7, 1989

[54] METHOD AND APPARATUS FOR CONTROLLING THE ELECTROSTATIC PARAMETERS OF AN ELECTROPHOTOGRAPHIC REPRODUCTION DEVICE

[75] Inventors: Saied A. Mabrouk, Boulder; Gerald L. Wheeler, Longmont, both of Colo.

[73] Assignee: International Business Machines Corporation, Armonk, N.Y.

[21] Appl. No.: 183,216

[22] Filed: Apr. 19, 1988

[51] Int. Cl.[4] ..... G03G 15/00

[52] U.S. Cl. ..... 355/208; 355/214; 355/219; 355/246; 430/31; 346/160.1

[58] Field of Search ..... 355/14 R, 14 CH, 14 E, 355/14 D, 203, 208, 214, 219, 246, 268; 430/30, 31, 100, 902; 346/160, 160.1, 153.1

[56] References Cited

U.S. PATENT DOCUMENTS

| | | | |
|---|---|---|---|
| 3,788,739 | 1/1974 | Coriale | 355/14 E |
| 3,835,380 | 9/1974 | Webb | 324/72 |
| 4,466,731 | 8/1984 | Champion et al. | 355/14 D |
| 4,468,112 | 8/1984 | Suzuki et al. | 355/14 D |
| 4,542,981 | 9/1985 | Anazi et al. | 355/14 E |
| 4,582,839 | 4/1986 | Suzuki | 355/14 R |
| 4,625,176 | 11/1986 | Champion et al. | 324/458 |

*Primary Examiner*—Arthur T. Grimley
*Assistant Examiner*—J. Pendegrass
*Attorney, Agent, or Firm*—Charles E. Rohrer; Francis A. Sirr

[57] ABSTRACT

The saturation voltage of a photoconductor used in a discharged area development (DAD) reproduction device is used to control and maintain the voltage vectors that are associated with (1) the photoconductor's fully charged background area, (2) the development electrode voltage at the reproduction device's developer station, (3) the photoconductor voltage in areas that are occupied by image characters having a small surface area, and (4) the photoconductor voltage in a test patch area that is associated with a toner concentration control network having a toner patch sensor. These electrstatic parameters are periodically adjusted, to compensate for changes in the operating characteristics of the photoconductor and the imaging station.

18 Claims, 3 Drawing Sheets

METHOD AND APPARATUS FOR CONTROLLING THE ELECTROSTATIC PARAMETERS OF AN ELECTROPHOTOGRAPHIC REPRODUCTION DEVICE

DESCRIPTION

1. Field of the Invention

The present invention relates to the field of electrophotographic reproduction, and more particularly to methods and apparatus for establishing and controlling the electrostatic parameters of reproduction devices.

2. Background of the Invention

The term electrostatic parameters of a reproduction device, as used herein, is defined as the voltage relationships that exist between the voltage to which the photoconductor is initially charged, the voltage of the photoconductor in its various discharged areas, such as image areas, and/or the developer station's development electrode voltage. These relationships are represented in FIGS. 1, 3, 4 and 5.

The present invention provides a method and apparatus for establishing and controlling the electrostatic parameters of a DAD reproduction device as a function of the photoconductor's saturation voltage.

The photoconductor's saturation voltage is defined as the voltage to which the photoconductor is discharged by high intensity illumination, and beyond which the photoconductor is not appreciably discharged by increasing the illumination intensity.

Electrostatic reproduction devices can be classified into two categories; those that develop (i.e., apply toner to) the charged area of a reusable photoconductor (known as CAD devices), and those that develop the discharged area of the photoconductor (known as DAD devices).

In CAD devices, the quality of the reproduced document's background area is dependent upon the magnitude of the photoconductor's saturation voltage; whereas, in DAD devices, the quality of the document's readable image is dependent upon the photoconductor's saturation voltage. Thus, the photoconductor's saturation voltage is more critically related to reproduction image quality in a DAD device than it is in a CAD device.

The present invention relates to reproduction devices of the DAD type, and to the improvement of reproduction by controlling the device's electrostatic parameters as a function of the photoconductor's saturation voltage. A xerographic printer is an example of a DAD reproduction device.

In a DAD reproduction device, the readable image portions of a DC charged photoconductor are discharged by an imaging station, for example a light emitting diode (LED) printhead or a scanning laser beam(s). This imaging station selectively discharges those portions of the photoconductor that correspond to the visual image to be formed on a substrate material. Usually, a black toner image is formed on white paper.

Operation of the printer's imaging station leaves a reverse-reading, discharged (i.e., usually a relatively low charge, rather than a zero charge) latent image on the photoconductor. The photoconductor's discharged latent image areas are surrounded by the photoconductor's highly charged background area. In a DAD device, the photoconductor's background area corresponds to the paper's white background area.

The photoconductor is then passed through a developer station whereat toner that carries a charge of the same polarity as the photoconductor's charged background area deposits on the photoconductor's discharged image area.

Such a developer station usually includes a developer mix made up of relatively large carrier beads and relatively small particles of polymeric toner powder. The toner's polymer content is selected to impart a desired DC charge to the toner, relative the photoconductor's charge, usually by triboelectric interaction with the carrier beads. In some magnetic brush developers, the toner itself is magnetic, and the carrier beads can therefore be eliminated from the developer mix.

Developer stations usually include a development electrode. That is, a development nip is formed with the moving photoconductor such that toner transfers from the developer station to the photoconductor's latent image in the presence of a development electrode electric field. This electric field can be an AC field, a DC field or a field that includes both AC and DC components.

A well known developer station is a magnetic brush developer. This developer typically includes a rotating cylindrical roller having a magnetic field associated therewith. A source of development electrode voltage is connected to the roller to provide the above-mentioned development electrode electric field.

In an exemplary DAD device in accordance with the invention, as is exemplified by FIGS. 1 and 2, photoconductor 31 is charged to a negative 550 volts DC (voltage Vd of FIG. 1), and is discharged to about a negative 100 volts DC (Vs) in fully discharged latent image areas. The toner in this exemplary device carries a negative charge. As a result, toner deposits on the photoconductor's relatively discharged latent image areas. The development electrode voltage (Vbias) for this exemplary DAD device is about −300 volts DC.

FIG. 1 also identifies two other photoconductor image voltages, Vc and Vp. Voltage Vc is the photoconductor voltage in the small areas of the photoconductor. Examples of such small image areas are alphanumeric characters that make up a portion of the total image to be reproduced. These small latent image areas will appear dense black on the printed sheet of white paper. Because of their small surface area, the photoconductor voltage need not be reduced to the Vs magnitude in order to achieve this level of toner blackness. Voltage Vs is the photoconductor's saturation voltage. This is the photoconductor voltage that is used for larger, solid black image areas. These larger areas likewise appear a dense black on the sheet. Because of their large surface area, the photoconductor's voltage must be reduced to the lower (i.e., less negative) level Vs in order to achieve the desired degree of toner blackness.

Voltage Vp is the photoconductor voltage used to produce a grey toner patch area. This photoconductor area is relatively large, and used with toner concentration control network 35,36 (FIG. 2), as will be described.

In summary, the photoconductor's background area voltage Vd is about −550 volts, its image area voltage Vs in large image areas is about −100 volts, its image area voltage Vc in small image areas is more negative than Vs, and its image area voltage Vp in the relatively larger patch area is also more negative than Vs.

The development voltage vector 12 (i.e., the development voltage field that negatively charged toner particle 20 experiences as the toner particle deposits on the photoconductor's solid image area Vs) is about +200 volts. As a result, negatively charged toner particles 20 flow from the −300 volt development electrode environment to (1) the less negative large image areas Vs to form a black image, (2) the less negative and relatively small area character image areas Vc to form a black image, and (3) the less negative but relatively large area patch image Vp to form a grey image. Toner 20 does not flow to the photoconductor's more negative −550 volt background area Vd.

It is well known that in such DAD reproduction devices the voltage magnitude to which photoconductor 31 (FIG. 2) is charged, for example, by use of gridded charge corona 30, unpredictably changes as a function of a number of operating parameters, such as, for example, the history of use of the photoconductor, a change in the operating characteristics of the charge corona power supply, and contamination of the charge corona.

It is also well known that the voltage to which the photoconductor is discharged, as a latent image is formed, unpredictably changes, for example, as a function of a change in the operating characteristic charge of the photoconductor and/or a change in the operating characteristic of imaging station 33. The invention provides a method and apparatus for establishing and controlling the electrostatic parameters of a DAD reproduction device as a function of the photoconductor's saturation voltage Vs.

Arrangements that compensate for changes in the operating characteristics of CAD reproduction devices are known in the art.

U.S. Pat. No. 4,542,981 discloses a copier, i.e., a CAD device, wherein degradation of the photoconductor is estimated, and steps are taken to control charging of the photoconductor in a manner to possibly compensate for this degradation. More specifically, the photoconductor of this device is simultaneously charged and illuminated by a light source. The voltage applied to this light source is varied in a manner proportional to the estimated degradation in sensitivity of the photoconductor.

U.S. Pat. No. 3,788,739 discloses a CAD copying apparatus wherein an electrometer is provided to measure the photoconductor's surface potential in a photoconductor area that is at the margin of the area exposed by an image exposure source. This marginal area always receives a maximum level of radiation. Thus, the electrometer indicates an image potential that corresponds to the maximum background levels that are provided by the image exposure source within the photoconductor's image area. The output of the electrometer may be used to control machine functions such as charging, exposure, transfer and developing.

U.S. Pat. No. 4,583,839 discloses another CAD copier wherein a surface potentiometer is used to measure the photoconductor's charge level in both its discharged background area and in its charged latent image area. The photoconductor's charge in its discharged area results from light that is reflected off a standard white plate, and the light that is reflected off an original document. The output of the surface potentiometer is used to control a number of the copier's operating parameters, including (1) the intensity of the copier's original document illumination lamp, (2) the voltage of the primary charge corona, (3) the voltage of the illumination station corona, (4) the voltage of the transfer station corona, (5) the voltage of the discharge corona, and (6) the magnitude of the developer station's development electrode field.

U.S. Pat. No. 4,466,731 discloses another CAD copier wherein an electrostatic probe is used to control certain of the copier's operating parameters. More specifically, this patent describes a toner concentration control scheme wherein an electrostatic probe measures the photoconductor's charge at a test patch image area, and adjusts the magnitude of the development electrode field so that toner concentration adjustment is made based upon toner that is deposited on a photoconductor test patch that has a grey level of charge.

U.S. Pat. No. 3,835,380 discloses another CAD copier device having an electrometer for measuring the photoconductor's surface potential. This patent suggests that the output of the electrometer can be used to control various copier machine functions.

While the prior art has attempted to control certain electrostatic parameters, these attempts have been associated with a CAD device where the photoconductor's discharged area voltage does not closely relate to the quality of the charged image which is to be toned by a developer station.

The present invention, on the other hand, controls electrostatic parameters as a function of the photoconductor's saturation voltage, and this voltage is critical to the quality of the image to be toned in a DAD device.

SUMMARY OF THE INVENTION

The present invention provides a method and an apparatus for establishing and maintaining the electrostatic parameters of a DAD reproduction device, despite changes in operating characteristics that occur with the passage of time, such as changes in the sensitivity of the photoconductor that may occur as the photoconductor ages.

In summary, the present invention provides a method and an apparatus whereby the photoconductor is first charged to a predetermined DC magnitude. This magnitude can, for example, be a default magnitude that has been predetermined to be an optimum magnitude to which the photoconductor will usually be charged during reproduction jobs.

A test area of the charged photoconductor is now illuminated in a manner that is known to reduce the voltage of this test area to its saturation voltage level. This saturation voltage level is the photoconductor voltage that is usually associated with images of large surface area.

By definition, the photoconductor's saturation voltage level is the lowest voltage to which the photoconductor can be discharged by a light source, i.e., a minimum photoconductor voltage which is not materially reduced by increasing the illumination intensity incident on the photoconductor.

During normal operation of the DAD reproduction device, those portion's of the photoconductor's discharged image area that are to appear as large black areas on paper will usually achieve this saturation voltage level (see Vs of FIGS. 1, 3, 4 and 5).

Relatively large, but somewhat smaller, image areas that are to appear grey on paper will not be discharged to this low level. For example, see voltage level Vp in FIGS. 1, 4 and 5. Voltage level Vp is, for example, associated with a grey toner patch that is formed to maintain a proper toner concentration in the developer station.

Small image areas that are to appear black on paper, such as the narrow lines of alpha-numeric text, will also not be discharged to the saturation level Vs, but rather will be discharged to the value Vc (shown in FIGS. 1, 4 and 5), but due to their small size, these areas will actually appear black on paper, due to the amount of toner that deposits thereon.

Preferably, the above-mentioned photoconductor test area is illuminated to achieve saturation voltage level Vs by using the device's imaging station 33 operating at its maximum light output condition. When this is done, the non-uniform operating characteristics of the imaging station can be compensated. For example, when the imaging station comprises an LED array, it is known that the numerous individual LEDs of the array do not provide the same light output for the same level of electrical energization. When the reproduction device is constructed and arranged such that the LED(s) having the weakest intensity output will drive the photoconductor to its saturation voltage, then the non-uniformity of LED radiation intensity is compensated.

The saturation voltage level of the photoconductor's test area is determined, for example by the use of an electrometer 37 that is mounted adjacent the moving photoconductor.

During the useful life of the photoconductor, the photoconductor's saturation voltage Vs will likely change in an unpredictable manner, depending, for example, upon photoconductor age and its prior work history. If this occurs, the changed value of the saturation voltage is used to reestablish the reproduction device's electrostatic parameters.

Also, should the sensitivity of the photoconductor and/or the light output of the imaging station (i.e., printhead) change, the imaging station's electrical energization is adjusted to maintain the same patch voltage Vp and small image area voltage Vc, as will be described.

In this manner, desired electrostatic relationships are established and maintained between (1) the photoconductor's saturation voltage Vs, (2) the photoconductor's charge Vd in highly charged image background areas, (3) the development electrode voltage Vbias, and (4) the photoconductor's various other discharged image voltages Vc and Vp, in a manner to provide optimum DAD performance of the reproduction device.

The foregoing and other features and advantages of the invention will be apparent from the following more particular description of preferred embodiments of the invention, as illustrated in the accompanying drawing.

THE INVENTION

Preferred embodiments of this invention will be described with reference to the DAD xerographic printer shown schematically in FIG. 2. Since DAD reproduction devices are well know to those of skill in the art, the device of FIG. 2 will not be described in great detail.

Figure 1:
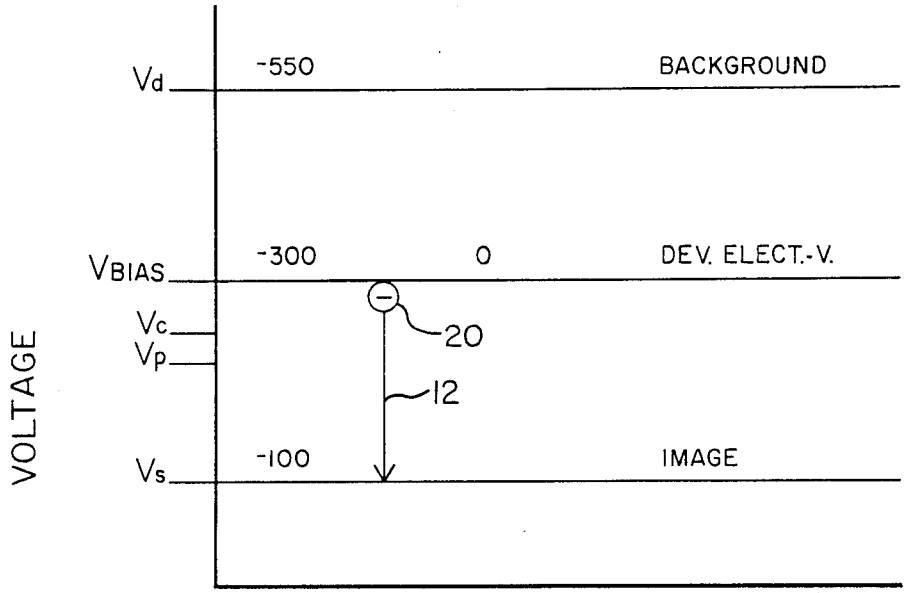
FIG. 1 shows the relative voltage magnitudes associated with a DAD reproduction device in accordance with the invention, namely, the development electrode voltage Vbias, the voltage Vd of the photoconductor in the non-image background area, the photoconductor voltage Vs in fully discharged image areas such as are associated with large, solid-fill image areas, the photoconductor voltage Vc in small image areas, and the photoconductor voltage Vp in a relatively large toner concentration sensing patch area that is to be toned to a grey shade.
Figure 2:
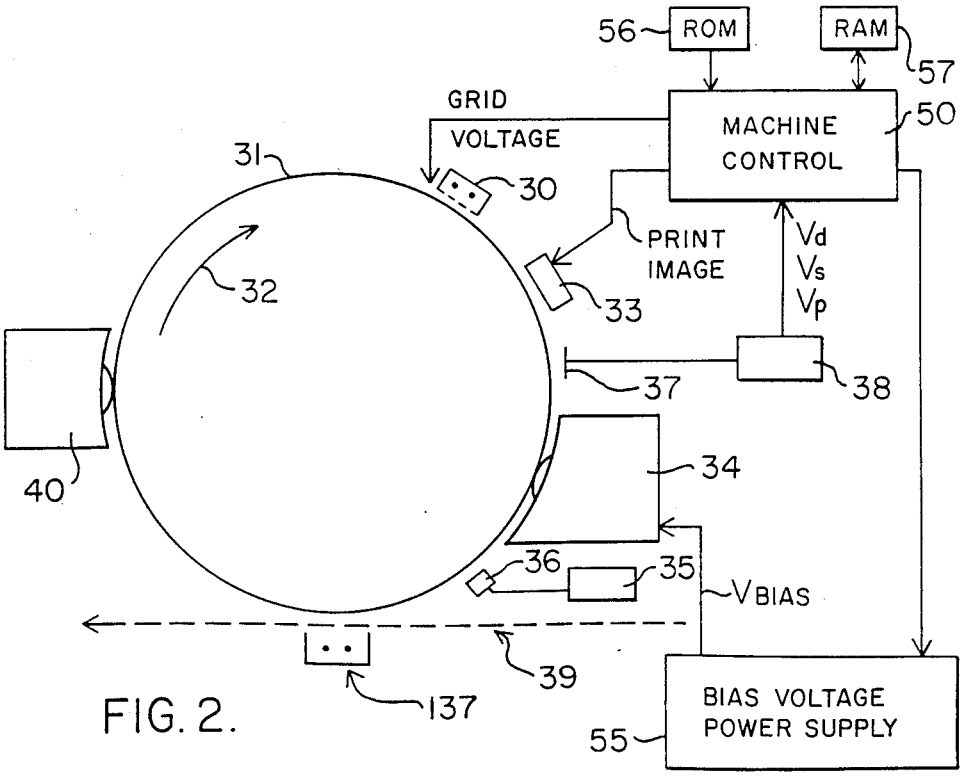
FIG. 2 is a showing of a DAD reproduction device in accordance with the invention.

The printer of FIG. 2 includes a gridded charge corona 30 that is operable to charge drum shaped photoconductor 31, as this drum rotates at a substantially constant speed in the direction indicated by arrow 32. An imaging station comprising LED printhead 33 operates to discharge selected areas of photoconductor 31 in accordance with the binary print image applied thereto, thereby forming a discharged latent image on photoconductor 31. A developer station comprising magnetic brush developer 34 operates to tone the photoconductor's latent image. Developer station 34 includes development electrode voltage source 55.

The multiple line image of the page being printed is contained in RAM memory 57 as many lines of multi-digit binary words. This portion of memory 57 comprises an electronic page image.

The printer is constructed and arranged to selectively energize each individual LED of printhead 33 in accordance with the type of image being formed on a given LED's picture element (PEL) area of photoconductor 31. An LED control algorithm, contained in ROM 56, may be used to determine if a given individual PEL area is associated with a small image area such as a text character, or if the PEL area is associated with a large image area.

If a PEL is associated with a small image area, the LED is energized to produce illumination intensity 16 of FIGS. 3, 4 and 5, photoconductor voltage Vc (called character voltage) is then produced in that photoconductor PEL area (assuming that the electrostatics have been initialized for curve 17, as will be explained). Voltage vector 11 is the difference between the photoconductor voltages Vs and Vc.

If the above-mentioned PEL is associated with a large image area, then the LED is energized to the maximum level 14, and the saturation voltage level Vs is produced on photoconductor 31 for that PEL.

As is well known, individual LEDs do not exhibit the same output characteristics, (i.e., when LED light output is plotted as a function of the magnitude of LED energization). In order to reduce the undesirable effects of LED intensity non-uniformity, large image areas must be discharged to (or very near) saturation level Vs of the photoconductor. If this is not done, shades of black and grey may appear within a large image area that should be all black (assuming the use of black toner).

The present invention insures that the printer's electrostatic parameters are set and maintained to eliminate such grey areas in large black image areas, and to maintain voltage vectors 11–13 at the magnitudes that are established by the reproduction device's manufacturer. The invention accomplishes this result independent of shifting of the photoconductor's characteristic curve, for example shifting of the curve from state 17 to state 17' in FIG. 3, or shifting from state 17 to state 17''' in FIG. 4.

The printer of FIG. 2 includes toner concentration control means 35,36 having a light reflection type patch sensor 36. This control means is provided to control the concentration of toner in developer station 34. Such a means is described in abovementioned U.S. Pat. No. 4,466,731, incorporated herein by reference.

Electrostatic probe (ESP) means 37,38, having a sensing probe 37, is provided to measure or sense the voltage level of selected areas of photoconductor 31. Such a means is described in U.S. Pat. No. 4,625,176, incorporated herein by reference.

The major portion of the photoconductor's toned image is transferred to paper substrate at transfer station 137, as the paper moves along path 39. A cleaning station 40 thereafter operates to clean photoconductor 31 of residual toner, prior to reuse of the photoconductor in the reproduction process.

In such a DAD reproduction device, the photoconductor's background areas remain highly charged, and toner is deposited only on the photoconductor's discharged latent image areas by developer station 34.

While FIG. 2 comprises an embodiment of the invention, the spirit and scope of the invention is not to be limited to this specific construction and arrangement shown.

In this printer, the image to be reproduced on paper is contained in a page memory such as RAM 57 as a binary electronic image. For example, the page memory includes a memory cell for each PEL. A binary "1" in a memory cell indicates that the corresponding PEL is to be colored by toner, and that the corresponding photoconductor PEL is to be discharged. This electronic image is gated to printhead 33, to activate the printhead's many LEDs in synchronism with movement of photoconductor 31 past the printhead.

In accordance with the present invention, the printer's electrostatic parameters are set to values that are based upon the saturation voltage or charge level Vs of photoconductor 31.

Each individual LED of printhead 33, when energized, illuminates a small photoconductor PEL, and discharges that PEL in accordance with the magnitude of the LEDs energization. In general, the higher an LED's energization, the more will the photoconductor's PEL be discharged.

Figure 3:
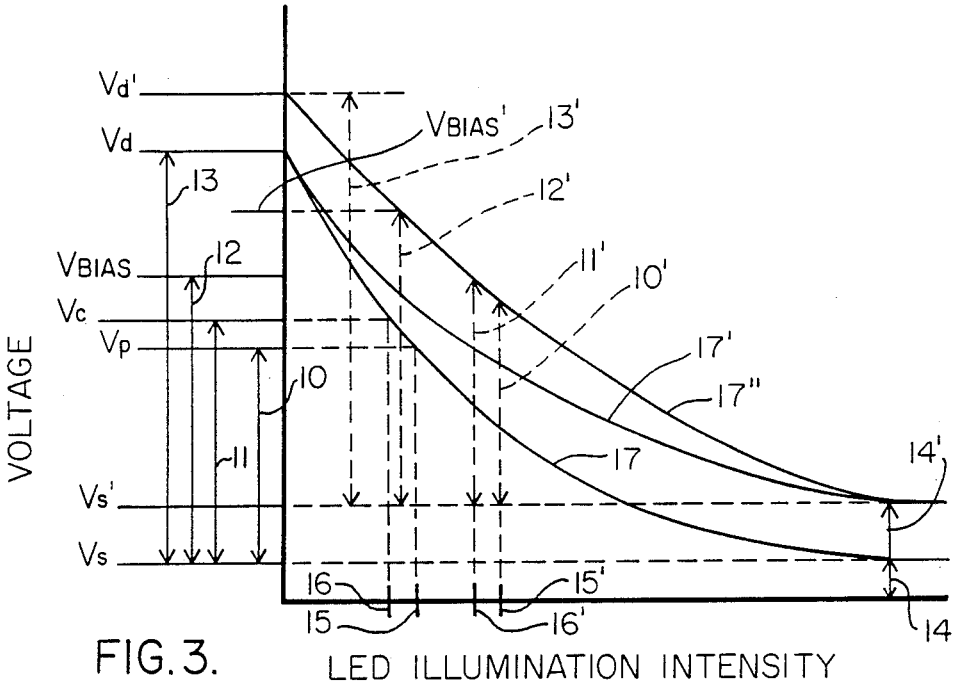
FIG. 3 graphically shows the various electrostatic parameters of the DAD reproduction device of FIG. 2, this figure being used to explain and understand how the device's electrostatic parameters are established and maintained by the invention, based upon an initial photoconductor characteristic curve 17 that shifts to state 17′, and is reestablished to state 17″ by operation of the invention.
Figure 4:
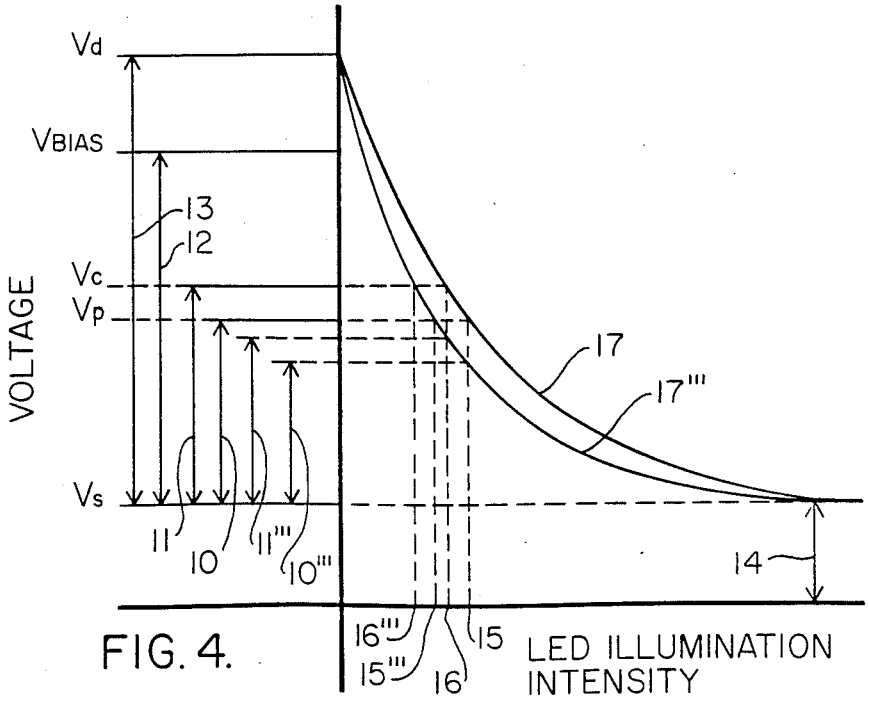
FIG. 4 shows operation of the invention to reestablish the electrostatics of the reproduction device of FIG. 2 in a situation where a changing physical parameter such as temperature has caused the photoconductor's characteristic curve to move from an initial condition 17 to a condition 17‴.
Figure 5:
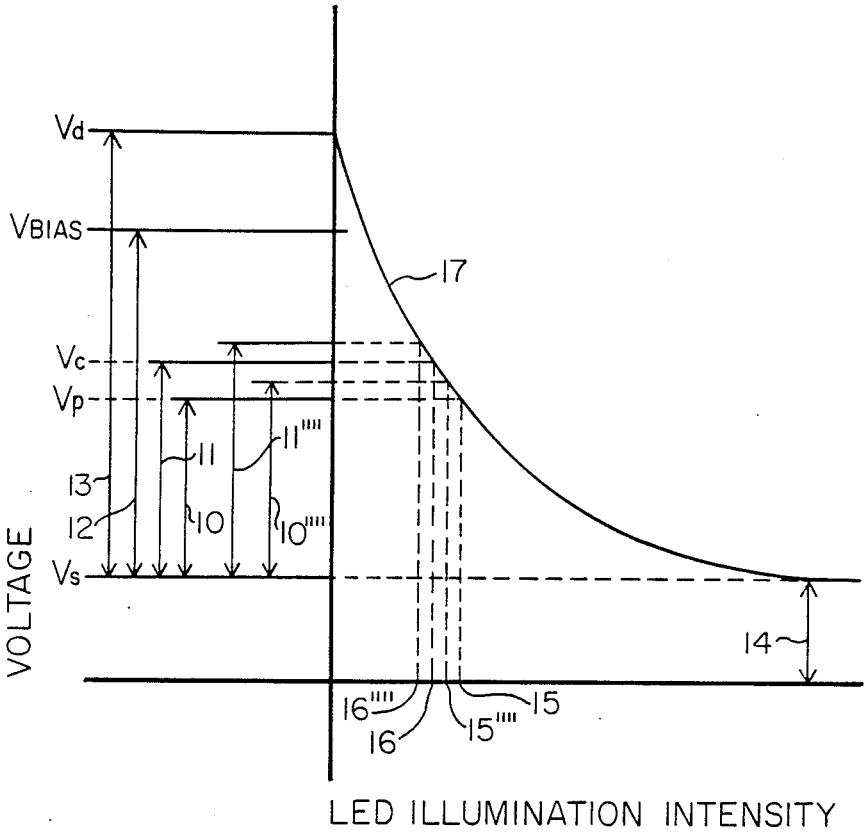
FIG. 5 shows operation of the invention to reestablish the electrostatics of the reproduction device of FIG. 2 in a situation where a changing physical parameter such as temperature has caused the imaging station's illumination characteristic to move from an initial condition 15 to a condition 15⁗.

In FIGS. 3, 4 and 5, curve 17 is a representative showing of how the printer's multi-layer photoconductor 31, which is initially charged to a voltage value of Vd, is discharged to lower and lower voltages by increasing amounts of LED illumination intensity. The magnitude of the photoconductor's initial charge voltage Vd is controlled, for example, by the voltage that is applied to the grid of charge corona 30 by machine control 50.

In these figures, voltage vectors 12 and 13 are predetermined design point vectors. These two vectors define the desired voltage difference that is to be maintained (1) between the photoconductor's saturation voltage Vs and the voltage Vd to which the photoconductor is charged by the printer's charge corona 30, and (2) between the photoconductor's saturation voltage Vs and the developer station's development electrode voltage Vbias. The magnitudes of these two vectors are stored in ROM 56.

An object of the invention is to control and maintain voltage vectors 12 and 13.

Voltage vectors 10 and 11 are also predetermined design point vectors whose magnitudes are stored in ROM 56. These two vectors define the desired voltage difference that is to be maintained (1) between the photoconductor's saturation voltage Vs and the voltage Vp to which the photoconductor is discharged by printhead 33 in the relatively large toner patch area, and (2) between the photoconductor's saturation voltage Vs and voltage Vc to which the photoconductor is discharged by printhead 33 for those photoconductor PELs associated with a small image area.

Curve 17 is always of the general shape shown in these figures. However, the exact shape of curve 17 is dependent upon factors such as the age and the prior work cycle history of photoconductor 31. Curve 17 can change, for example to take shape 17', as shown in FIG. 3, as photoconductor 31 ages (note that the value of Vd has not changed for curve 17').

Curve 17 can also change, for example, to take shape 17''', as shown in FIG. 4, as the photoconductor experiences a cold start condition, followed by warming up as the reproduction device is used.

Another exemplary condition is shown in FIG. 5, where curve 17 does not change, but printhead 33 experiences a cold start, followed by warming up as the reproduction device is used.

The photoconductor's saturation voltage Vs is defined as the voltage below which photoconductor 31 is not appreciably discharged by increasing the amount of illumination striking the photoconductor.

Saturation voltage Vs is the saturation voltage of a photoconductor whose voltage/illumination characteristic is represented by curve 17. The illumination intensity that reduces or drives the photoconductor voltage from the initial charge magnitude Vd to the voltage level Vs is the illumination that is produced by about 100% (i.e., maximum) energization of LED printhead 33. This condition of maximum printhead energization is shown in FIG. 3 by two coincident illumination intensities 14 and 14'. As shown, the curves 17 and 17' of FIG. 3 have different saturation voltage values Vs and Vs' for the same level 14, and 14' of maximum LED illumination. As can be seen, saturation voltage level Vs' for curve 17' is higher in magnitude (i.e., more negative) than saturation voltage level Vs for curve 17.

The photoconductor's saturation voltage level is generally independent of the voltage Vd to which photoconductor 31 is initially charged by charge corona 30. For example, compare Vs and Vs' for curves 17 and 17' in FIG. 3.

This invention makes use of this fact to maintain the device's electrostatic parameters when the characteristics of photoconductor 31 move from the condition shown in curve 17, and when the characteristics of printhead 33 change as shown in FIG. 5.

In FIGS. 3, 4 and 5, the voltage magnitude which is identified as Vbias is the development electrode voltage that is applied to the development roll(s) within the printer's magnetic brush developer station 34 by power supply 55.

Voltage vector 12 is the difference between the voltages Vs and Vbias. This vector is called the black image area, or large image area, development vector. The magnitude of this vector has been established by the printer's manufacturer during design and development of the printer. The magnitude of this vector is stored in ROM 56.

In the printer shown in FIG. 2, toner concentration (i.e., the percentage of toner in the developer mix) of magnetic brush developer 34 is controlled by patch sensor means 35,36.

In this toner concentration control system, a relatively large area of the photoconductor, called a test patch area, which is located between adjacent photoconductor page image areas, is illuminated by certain LEDs of printhead 33 to an intensity 15. This illumination intensity forms a relatively large test image (i.e., large when compared to the narrow lines making up a text character) which, when toned, appears grey. The light reflected from this grey patch is compared to the light that is reflected from an untoned bare area of photoconductor 31, by using reflective photocell/light source system 36. A decision is thereby made as to the need to add toner to the developer mix in developer 34.

The photoconductor voltage in this test patch area is designated as Vp (patch voltage). Voltage vector 10 is the difference between photoconductor voltages Vs and Vp.

The following method steps of the invention are used to initially set the printer's electrostatic parameters to achieve curve 17. For example, the following method is enabled each time the printer is turned on.

(1) Developer station 34 is temporarily rendered inoperative to deposit toner on photoconductor 31.

(2) The value of the charge corona's grid voltage is set to a predetermined default value contained in ROM 56, and photoconductor 31 is thereafter charged. The default value for the charge corona's grid voltage may, for example, be a value that is expected to result in photoconductor 31 being charged to a predetermined target value of 550 volts (i.e., Vd=550 volts).

(3) The resultant actual value of Vd is sensed by passing the charged photoconductor adjacent to ESP 36.

(4) Steps 2 and 3 are repeated, and the charge corona's grid voltage is adjusted until the above-mentioned predetermined target magnitude for Vd is actually achieved.

(5) Photoconductor 31, which is now charged to the target value of Vd, is now illuminated by printhead 33 to discharge the photoconductor to its saturation level Vs. For example, in the above-mentioned test patch area, 100% or maximum energization of the associated printhead LEDs is used. This high LED energization is known to reduce photoconductor 31 to about its saturation voltage level Vs, independent of the exact shape of curve 17. As was mentioned, this value of LED energization (i.e., 100% energization), and the resulting saturation value Vs of photoconductor 31 is used to produce photoconductor PEL areas that are associated with large black image areas.

(6) The resulting magnitude of Vs is now measured, using ESP 36. This magnitude is stored in RAM 57.

(7) The known magnitude of the design point voltage vector 13, for example 450 volts, is now used to calculate the desired value of Vd (i.e., Vd=the Vs of step 6+the design magnitude of vector 13), and steps 2 and 3 are repeated as the charge corona's screen voltage is changed to a value that will achieve this calculated value of Vd on photoconductor 31, as this charge is measured by ESP 37.

At this point, the present invention has established voltage vector 13 at its desired magnitude, dependent upon the measured magnitude of the photoconductor's saturation voltage Vs.

As a further feature of the invention, the magnitude of vector 12 is set by the following step.

(8) The known design magnitude of voltage vector 12, for example 200 volts, is now used to set the magnitude of Vbias (i.e., Vbias=the Vs of step 6+the design magnitude of vector 12) by the use of machine control 50 to adjust bias voltage power supply 55.

At this point, the present invention has established both vector 13 and vector 12 to their design values. As a further feature of the invention, LED energization level 15, which is based upon the design magnitude of vector 10, is established by the following steps.

(9) The known design magnitude of voltage vector 10 is now used to calculate the value of photoconductor voltage Vp (i.e., Vp=the Vs of step 6+the design magnitude of vector 10).

(10) Thereafter, the level of LED illumination 15 (i.e., the level of LED energization that is used by patch sensor means 35,36) is determined by varying the energization level of certain printhead LEDs until the photoconductor voltage level Vp is achieved in the photoconductor's test patch area, as this charge is measured by ESP 37. This level of LED energization is stored in RAM 57 and is thereafter used when illuminating the toner test patch area.

At this point, the invention has established voltage vectors 13, 12 and 10. As a further feature of the invention, LED energization 16 is established as follows.

(11) The level of LED energization 16 is now set. This level of LED energization will thereafter be used to energize LEDs for PELs that are associated with small image areas, to thereby produce photoconductor voltage level Vc for these small image areas. This is done by using the value of LED energization 15 as determined in step 10. LED energization level 16 is a magnitude that equals level 15 multiplied by a constant, i.e., the ratio of 15 to 16 is a constant, where the constant can be greater than or less than 1. This value of LED energization is also stored in RAM 57.

At this time, all of the electrostatic parameters of the printer have been set, based upon the photoconductor's characteristic curve 17 and upon the photoconductor's saturation voltage level Vs. Developer station 34 is now activated, and print jobs can begin.

The above method of initializing the printer's electrostatic parameters is preferably repeated each time the printer is turned on, and perhaps each time the printer is requested to produce a new print job from an idle condition. In the latter case, the printer's electrostatic parameters are initialized a number of times each day.

The above process is called electrostatics initialization

As use of the printer continues, following electrostatics initialization, photoconductor characteristic curve 17 may shift (usually very slowly) toward the state shown at 17' (FIG. 3). When this happens, actual value of Vs shifts upward (i.e., more negative) to Vs'. At this time the value of Vd has not changed, Vbias and the illumination levels 15 and 16 have likewise not changed. As a result of this shift in the photoconductor's characteristic curve from 17 to 17', the values of photoconductor voltages Vc and Vp increase from the values that were initially set based upon curve 17.

More specifically, photoconductor voltages Vc and Vp become more negative since the magnitude of these voltages is now determined by curve 17'.

This condition is sensed by ESP 37 which, for example, measures the change in magnitude of voltage Vp in the photoconductor s patch area. Corrective action as described below is now taken.

As can be seen from FIG. 3, when the photoconductor's characteristic curve changes from curve 17 to 17', the value of Vp becomes more negative. This is true because the level of LED energization 15 remains as previously initialized, but the effect of this level of illumination on the photoconductor is to now discharge the photoconductor in accordance with curve 17', and not in accordance with initial curve 17.

When this change in voltage Vp is sensed by ESP 37,38, machine control 50 interprets this change as an increase in the photoconductor's saturation voltage level from Vs to Vs', since it is known that Vd has not changed.

As a result, machine control 50 implements an increase in Vd, for example to the value Vd'. This results in the photoconductor's characteristic curve shifting to that shown at 17''. In addition, all other electrostatic parameters are now recalculated and shifted accordingly. Note that the saturation voltage level Vs' is the same for both curves 17' and 17'' since the photoconductor's saturation voltage level does not vary as a function of the photoconductor's charge level Vd'.

As a result, new LED illumination levels 15' and 16' continue to produce vectors 10' and 11' for the photoconductor's patch area and character areas, respectively. The magnitude of vectors 10' and 11' is substantially equal to the magnitude of vectors 10 and 11, respectively. As before, 100% energization of the printhead LEDs is used for large image areas, thereby producing photoconductor voltage Vs' relative curve 17''.

FIGS. 4 and 5 represent two additional situations in which the present invention finds utility.

More specifically, FIG. 4 represents a situation in which the electrostatics of the reproduction device are initialized to curve 17, as above described, and in which the temperature of the photoconductor is relatively cool during initialization. Later, the photoconductor heats up, to thereby establish photoconductor characteristic curve 17'''.

In FIG. 5, a change in the characteristics of the imaging station, for example an LED printhead, has occurred, such that the level of electrical energization that initially produced illumination intensity 15, now produces intensity 15'''', and likewise intensity 16 has been reduced to intensity 16''''. The situation of FIG. 5 also may represent a cold start of the reproduction device.

To compensate for these effects, the photoconductor's patch voltage Vp is occasionally measured during a reproduction run, typically this is done every 50 to 100 reproductions.

The measurement of Vp is accomplished by illuminating the photoconductor's toner patch area while the printhead is energized using the latest energization control value 15 that is stored in RAM 57. The magnitude of the resulting patch vector (for example, vector 10''' of FIG. 4 and vector 10'''' of FIG. 5) is now sensed, using ESP 37. If a change in the vector's magnitude from the design value stored in ROM 56 is detected (i.e., a change has occurred from vector 10 of FIG. 4 to vector 10''', or a change has occurred from vector 10 of FIG. 5 to vector 10''''), machine control 50 operates to change the printhead's illumination intensity value (i.e., illumination intensity is changed to value 15''' for FIG. 4, and illumination intensity is changed to value 15'''' for FIG. 5) so as to maintain the design magnitude for the grey patch vector Vp.

Since the small area or character vector 11 is derived from vector 10, this vector is likewise reestablished (i.e., at 16''' for FIG. 4, and at 16'''' for FIG. 5.

While FIGS. 3, 4 and 5 depict three separate situations for which the present invention finds utility, it is recognized that other situations may exist, and that these situations may occur simultaneously. For simplicity, these situations have been described in separate, isolated, fashion.

In the above-described manner, the method and apparatus of the present invention operates to maintain the electrostatic parameters of a DAD reproduction device at optimum values during the lifetime of the device.

While the invention has been described with reference to preferred and exemplary embodiments, the scope and spirit of the invention is not to be limited thereto, but rather is defined by the following claims.

What is claimed is:

1. A method for establishing electrostatic parameters of a DAD electrophotographic reproduction device, said device having a photoconductor, a charging station for charging said photoconductor, an imaging station which is operable to form a discharged area latent image on said photoconductor in accordance with an image to be reproduced, and a developer station operable to deposit toner on said latent image, said developer station including a development electrode connected to a source of development electrode voltage, comprising the steps of:

determining the saturation voltage of said photoconductor;

establishing said electrostatic parameters as a function of said determined saturation voltage; and adjusting the magnitude of said development electrode voltage as a function of said determined saturation voltage.

2. The method of claim 1 wherein said development electrode voltage is adjusted to produce a predetermined difference between said development electrode voltage and said determined saturation voltage.

3. The method of claim 2 including the step of periodically repeating said method in order to periodically compensate for changes in the operating characteristics of said reproduction device.

4. The method of claim 3 including the step of rendering said developer station inoperative to deposit toner on said photoconductor while said method is practiced.

5. A method for establishing electrostatic parameters of a DAD electrophotographic reproduction device, said device having a photoconductor, a charging station for charging said photoconductor, an imaging station which is operable to form a discharged area latent image on said photoconductor in accordance with an image to be reproduced, and a developer station having a development electrode connected to a source of development electrode voltage, comprising the steps of:

determining the saturation voltage of said photoconductor by charging said photoconductor by operation of said charging station, discharging at least a portion of said photoconductor by operation of said imaging station at about its maximum discharge output, and using charge sensitive means to measure the resultant charge on said photoconductor portion;

adjusting the voltage to which said photoconductor is charged as a function of the magnitude of said determined saturation voltage; and adjusting the magnitude of said development electrode voltage as a function of said determined saturation voltage.

6. The method of claim 5 wherein said development electrode voltage is adjusted to produce a predetermined difference between that voltage and said determined saturation voltage.

7. The method of claim 6 including the step of periodically repeating the steps of said method in order to periodically compensate for changes in the operating characteristics of said reproduction device.

8. The method of claim 7 including the step of rendering said developer station inoperative to deposit toner on said photoconductor while said method is practiced.

9. A method for controlling electrostatic parameters of a DAD xerographic reproduction device, said device having a photoconductor, a charging station for charging said photoconductor, an imaging station for forming a discharged area latent image on said photoconductor in accordance with an image to be reproduced, and a developer station operable to deposit toner on said latent image, said developer station including a development electrode connected to a source of development electrode voltage, comprising the steps of:

charging at least a portion of said photoconductor to a nominal operating voltage;

discharging said photoconductor to the saturation voltage thereof;

determining the magnitude of said photoconductor saturation voltage;

adjusting the voltage to which said photoconductor is charged as a function of said determined magnitude in order to produce a predetermined voltage difference between the voltage to which said photoconductor is charged and said determined magnitude; and adjusting the magnitude of said development electrode voltage as a function of said determined magnitude.

10. The method of claim 9 wherein said development electrode voltage is adjusted to produce a predetermined difference between the development electrode voltage and said determined magnitude.

11. The method of claim 10 including the step of disabling the ability of said developer station to deposit toner on said latent image while said method is practiced.

12. A method for controlling electrostatic parameters of a DAD xerographic reproduction device, said device having a photoconductor, a charging station for charging said photoconductor, an LED printhead imaging station for forming a discharged area latent image on said photoconductor in accordance with an image to be reproduced, and a developer station operable to deposit toner on said latent image, comprising the steps of:

charging at least a portion of said photoconductor to a nominal operating voltage;

discharging said photoconductor to the saturation voltage thereof by operating said LED printhead at substantially its maximum illumination level;

determining the magnitude of said photoconductor saturation voltage; and controlling said electrostatic parameters as a function of said determined magnitude.

13. The method of claim 12 including the step of rendering said developer station inoperative to deposit toner on said photoconductor while said method is practiced.

14. The method of controlling electrostatic parameters of a DAD electrophotographic reproduction device having a reusable photoconductor, a charging station for charging said photoconductor, a charging station for forming a discharged latent image on said charged photoconductor, comprising the steps of:

providing a charge reference vector usable for determining the voltage to which said photoconductor is to be charged during reproduction runs;

charging at least a portion of said photoconductor to a nominal voltage;

discharging said photoconductor to the saturation voltage thereof;

determining the magnitude of said saturation voltage;

thereafter, during subsequent reproduction runs, charging said photoconductor to a magnitude that is a function of said determined magnitude and said charge reference vector;

providing a developer station operable to deposit toner on said latent image, said developer station having a developer electrode to which a source of development electrode bias voltage is applied;

providing a bias reference vector usable for determining the magnitude of bias voltage to be used during reproduction runs; and thereafter, during subsequent reproduction runs, providing a development electrode bias voltage whose magnitude is a function of said determined magnitude and said bias reference vector.

15. The method of claim 14 including the steps of:

providing a grey-latent-image reference vector for an image that is intended to be toned to a grey toner level by operation of said developer station during said subsequent reproduction runs;

determining a photoconductor grey charge magnitude that is a function of said determined magnitude and said grey latent image reference vector;

determining the level of imaging station intensity that is necessary to produce said determined grey charge magnitude; and thereafter, during subsequent reproduction runs, energizing said imaging station at a grey level intensity so as to achieve said determined grey charge magnitude.

16. The method of claim 15 including the additional steps to be executed during said subsequent reproduction runs;

sensing the grey level photoconductor voltage that is produced during a reproduction run by said imaging station while said imaging station is energized at said grey level intensity;

comparing said reproduction run grey level photoconductor voltage to said determined grey charge magnitude; and adjusting the energization of said imaging station in a manner to maintain said grey latent image reference vector.

17. A DAD reproduction device comprising:

a reusable photoconductor that cycles through a series of process stations during the process of producing reproductions, said process stations including in cycle order:

a controllable charging station operable to charge said photoconductor to an image background charge level;

a controllable intensity imaging station selectively operable to discharge said photoconductor to (1) a photoconductor-saturation latent image voltage level in a photoconductor image area, and (2) a relatively higher patch latent image voltage level in a photoconductor patch area;

charge sensing means operable to sense said photoconductor-saturation voltage level;

a developer station having a controllable development electrode bias voltage source, and being operable to deposit a high quantity of toner on said photoconductor image area, and a lower quantity of toner on said photoconductor patch area; and toner concentration control means operable to determine the quantity of toner deposited on said photoconductor patch area;

reference means providing a reference photoconductor charge vector and a reference development bias vector;

means for controlling said charge source as a function of said photoconductor-saturation voltage level and said charge vector reference; and means controlling said bias voltage source as a function of said photoconductor-saturation voltage level and said bias vector reference.

18. The reproduction device of claim 17 including:

additional reference means providing a reference patch voltage vector; and means to control the intensity of said imaging station as a function of said photoconductor-saturation voltage level and said patch voltage vector.

* * * * *